United States Patent [19]

McKernan et al.

[11] 4,116,360

[45] Sep. 26, 1978

[54] CAN END WITH PROTECTIVE FOLD

[75] Inventors: Bernard J. McKernan, Massillon; Donald E. Stargell, North Canton, both of Ohio

[73] Assignee: Van Dorn Company, Cleveland, Ohio

[21] Appl. No.: 229,678

[22] Filed: Feb. 28, 1972

[51] Int. Cl.[2] ..... B65D 41/32

[52] U.S. Cl. ..... 220/273

[58] Field of Search ..... 220/54, 48, 27, 90.6, 220/269–273

[56] References Cited

U.S. PATENT DOCUMENTS

| | | | |
|---|---|---|---|
| 3,450,301 | 6/1969 | Steck et al. | 220/54 |
| 3,451,586 | 6/1969 | Maliszewskit et al. | 220/48 |
| 3,490,643 | 1/1970 | Henning et al. | 220/54 |
| 3,682,350 | 8/1972 | Baugh et al. | 220/54 |
| 3,696,961 | 10/1972 | Holk | 220/54 |

*Primary Examiner*—George T. Hall

*Attorney, Agent, or Firm*—Frease & Bishop

[57] ABSTRACT

An aluminum food product container or can having an easily opened can end seamed to one end of the can body. The outer surface of the can end member has a score line along which the can end is severed for opening the can and removing an end panel. The score line is located adjacent and above a shoulder in the can body extending inwardly below the seam. A protective double fold is formed in the can end by extending the end metal annularly inwardly in a first layer from the score line, then reversely outwardly in a second layer beneath the first layer to a location circumferentially underlapping the score line location, and then reversely inwardly in a third layer beneath the first two layers into the can end panel portion. The double fold formation presents a dull hazard-free edge to the end panel when torn from the can end member.

5 Claims, 5 Drawing Figures

FIG.1
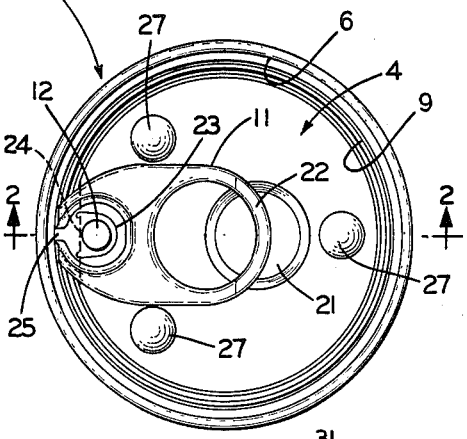
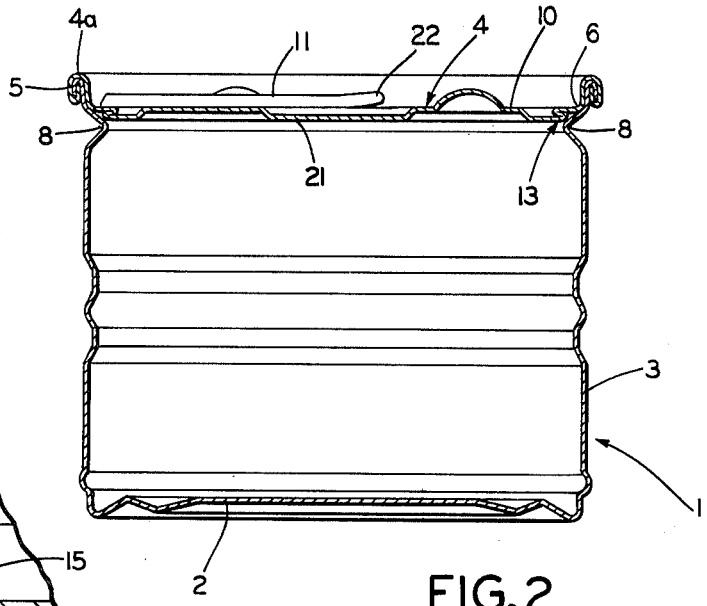
FIG.2
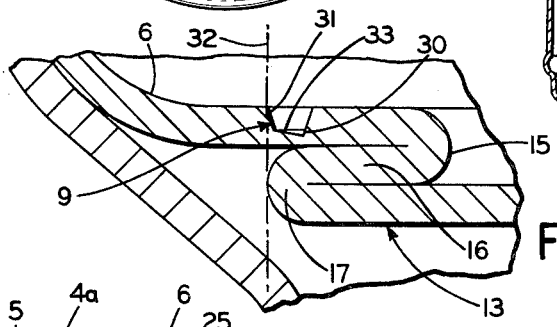
FIG.5
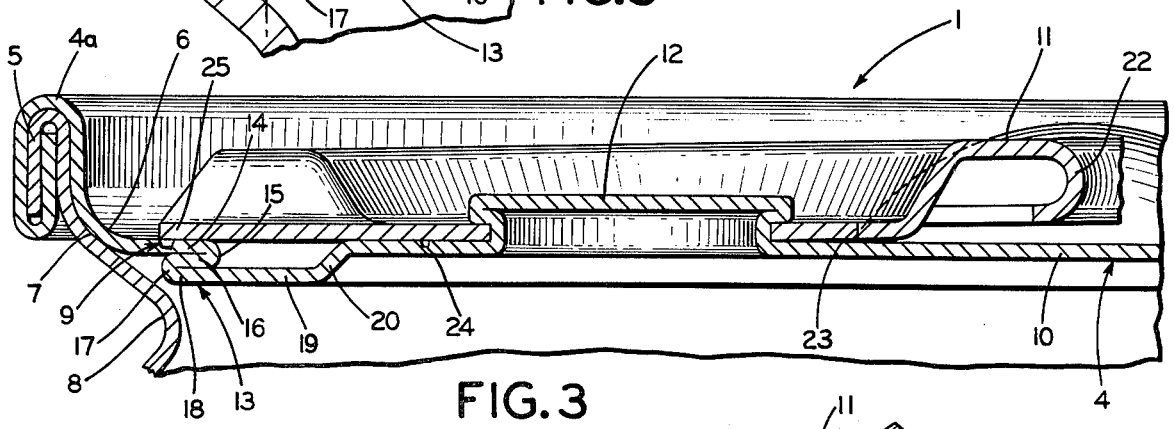
FIG.3
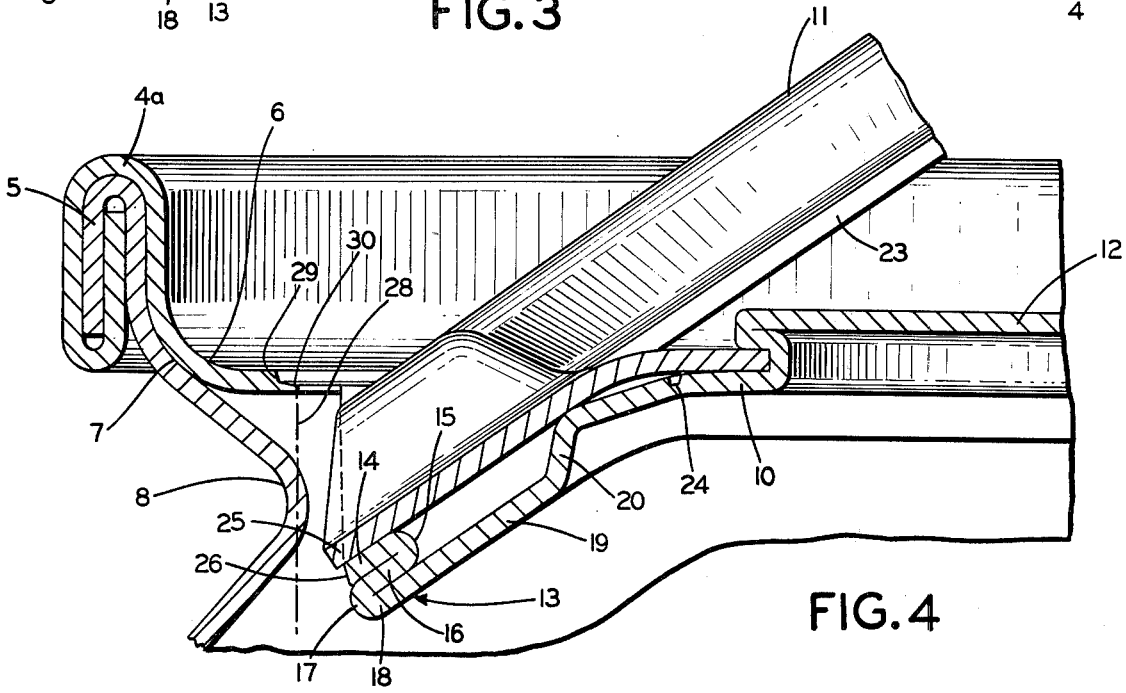
FIG.4

CAN END WITH PROTECTIVE FOLD

BACKGROUND OF THE INVENTION

1. Field of the Invention

The invention relates to food product cans that are provided with can end members which may be opened easily by tearing a portion thereof along a score line formed in the end member. Such food product cans including their bodies and end members desirably frequently are formed of aluminum. These cans, particularly in small sizes, have been popular for packing pudding and other snacks for children's lunch boxes. The food product cans may be of the types shown in Henning et al U.S. Pat. No. 3,490, 643 and in Bernard J. McKernan application Ser. No. 70,843 filed Sept. 9, 1970 allowed.

2. Description of the Prior Art

A number of can designs have been supplied to and used by food packers for packaging small quantities of snack foods such as puddings for children's lunch boxes. These cans have been made of aluminum and have had full opening container ends, the end panels of which are torn out using pull-rings attached to the can end panels.

Problems have been encountered in the use of such cans. Zipping off the lid or removable end panel in the can end wall is not always easy for children; all too frequently they cut their fingers on the sharp lid edge or on the rim left inside the can, and the lid almost nevers comes off without a thick coating of pudding sticking to its underside. The child tempted to lick the lid stands a good chance of cutting his tongue on the sharp edge. The removed lid has been found to be sharp enough to slice a chicken leg.

A report by a school teacher about cut tongues suggested that the can design should be changed to eliminate the hazard, and suggested that this would be easier than attempting to change the natural tendencies of a child to lick pudding sticking to the underside of a removed lid. One trade journal has described the cans as dangerous and has questioned whether the convenience of the cans is worth their hazard.

As a result, food packers that have used such cans have called for a solution to the problem which will eliminate the dangers and hazards.

SUMMARY OF THE INVENTION

Objectives of the invention include providing a new can end and container construction having a full opening removable end wall panel torn from the can end wall along a score line located immediately adjacent the seam between the can body and end wall in which the removed end panel has a dull protective edge formation which normally and ordinarily will not cut the finger, tongue or other body part of a person drawn along or across the edge of the removed panel; providing a new can end construction which has a removable panel that is not dangerous and does not present a hazard to a child who has zipped the end panel from a snack-containing can; providing a new can end construction which readily may be incorporated in prior can end structures of types which inherently presented the hazards described; providing a new can end structure having the new hazard-eliminating protective double fold dull edge formation on the removed end panel incorporated in a container construction having desirable features of the products shown and described in U.S. Pat. Nos. 3,179,282 and 3,490,643 and in said application Ser. No. 70,843; and providing a construction eliminating difficulties heretofore encountered, achieving the indicated objectives simply, effectively and inexpensively, and solving existing problems and satisfying existing needs in the canned food products field.

These objectives and advantages are obtained by the easy opening metal can and can end construction, the general nature of which may be stated as including an aluminum can end wall adapted to be seamed to the side walls of a metal can body by a usual double seam; the end wall having a recessed end panel extending from a recessed corner; the corner being located below the seam and being seated on an inwardly projecting annular shoulder or or bead formed in the can body side wall below the seam; and endpanel-defining continuous score line formed in the end wall close to the recessed corner; the can body bead projecting inwardly beyond the score line location so that when the can end is torn on the score line for end panel removal the severed edge remaining on the can is protected by the bead in hazard free condition; pull tab means secured to the end panel for tearing the end panel from the end wall; and a protective double fold formed in the end wall having a first metal layer extending annularly inwardly from the score line, then extending in a second layer reversely outwardly beneath the first layer to a location circumferentially underlapping and extending outwardly beyond the score line location, and then extending in a third layer reversely inwardly beneath the first and second layers and into the can end panel portion.

BRIEF DESCRIPTION OF THE DRAWING

FIG. 1 is a top plan view of a can provided with the new construction;

FIG. 2. is an enlarged vertical section taken on the line 2—2, FIG. 1;

FIG. 3 is a greatly enlarged view of the upper left-hand corner portion of FIG. 2;

FIG. 4 is a further enlarged view similar to FIG. 3, showing the parts after initiating the tearing out of the end panel by manipulation of the pull ring; and FIG. 5 is a further greatly enlarged fragmentary section illustrating the relationship between the end-fold, the score line, and the can bead.

Similar numerals refer to similar parts throughout the drawing.

DESCRIPTION OF THE PREFERRED EMBODIMENT

The invention is illustrated typically in the drawing applied to a small-sized can although the can may be of any one of a number of sizes or capacities, or of any one of a number of types made by various manufacturers, and which have a continuous score line in the can end wall adjacent the double seam between the can body and end wall.

The can 1, generally of conventional construction, has a cup-shaped body with a bottom wall 2, and side walls 3, and a can end wall 4, connected through a seam flange **4*a* by a usual double seam 5 to the upper or open end of the side walls 3. End wall 4 has a recessed corner 6 at the lower end of the double seam 5 preferably seated on a ledge or shoulder 7 formed by an inwardly projecting annular bead 8 formed in the side walls 3 below the seam 5**.

A curved score line 9 is formed in the end wall 4 very close to the recessed corner 6. The score line 9 defines an end panel 10 which is completely removable from the remainder of the end wall 4, when torn or peeled along score line 9 to provide a fully opened top for the can 1.

A ring pull tab 11 preferably is connected by a rivet 12 with the end panel 10 which may be made in any conventional manner, or may be accomplished as set forth in Henning et al., U.S. Pat. No. 3,346,948. Ring pull tab 11 preferably is formed of sheet metal of somewhat heavier gauge than the sheet metal from which can 1 and end wall 4 are formed. Members 1 and 4 are formed of aluminum. End wall 4 and ring pull tab 11 as thus far generally described may be made and have the same general structure that is shown in Henning et al., U.S. Pat. No. 3,490,643.

Also the interior can and end wall surfaces may be provided with an enamel coating to withstand the corrosive attack of food products packed in can 1. Further, the can end 4 may be coated with a sealing compound material on its undersurface beneath the score line 9 to protect the end wall metal in this area against corrosive attack as set forth in said copending application Ser. No. 70,843.

In accordance with the invention, the end wall 4 is formed with a protective double fold generally indicated at 13 extending completely around and underlapping the score line 9. Fold 13 comprises a first metal layer 14 extending annularly inwardly from the score line 9. Then the metal bends or folds at 15 to extend in a second layer 16 reversely outwardly beneath the first layer 14. Then the metal bends or folds at 17 to extend in a third layer 18 reversely inwardly beneath the first layer 14 and second layer 16. The metal extends inwardly from third fold layer 18 into the offset portion 19 of end wall 4. The offset portion 19 in effect forms an annular channel surrounded by the protective double fold 13 (FIG. 3) and merging by angular wall portion 20 with the main end panel 10 which preferably lies in the plane of the first fold layer 14.

A recess 21 may be embossed in the main panel 10 to facilitate grasping the ring portion 22 of pull tab 11 to open the can. Pull tab 11 may be lanced at 23 (FIG. 1) to permit easy flexing as the pull tab is moved to the position shown in FIG. 4 to rupture the end wall 4 along score line 9. Bending of the end wall as shown in FIG. 4 during rupture is further facilitated by providing a secondary score line 24 between rivet 12 and the nose 25 of pull tab 11.

The outer bend or fold 17 of the protective double fold 13 extends circumferentially beyond and below the location of the score line 9, as shown in FIGS. 3 and 4. This relation and the double fold 13 are of the essence of the invention. It has been discovered that when the main panel 10 is torn from the end wall 4 the torn raw metal edge 26 at the score line tear on the first fold layer 14 blends with the rounded reverse bend 17 to form a dull thick edge for the removed main panel 10 which does not present the cutting hazard characterizing prior devices.

Referring particularly to FIG. 4, the dot-dash line 28 represents the location of the profile 29 of the score line 9 that remains on that portion of the can end 4 on a can 1 after the main panel 10 is torn from the end wall 4. The inner diameter of the annular bead 8 formed in the side walls 3 is necked-in beyond the location of the remaining score line profile 29 shown by the intersection which is indicated at the dot-dash line 28 in FIG. 4, with the bead 8. Thus bead 8 protects torn edge 29 in a hazard free condition and the new construction retains the advantages and desirable features of the can construction of U.S. Pat. No. 3,179,282 while protecting the edge of the torn out panel.

Furthermore, the outer fold 17 on main panel 10 extends outwardly beyond the score profile 26 that remains on the main panel 10 when the panel 10 is torn from the end wall 4. This may be accomplished by using an angled face score blade and controlling the point of tear on the inside diameter 30 of the score profile. Alternatively, the angled face at the bottom of the score profile may be omitted, and the face may be flat at the bottom of the score profile, using a flat face score blade and extending the outer diameter of the fold 17 beyond the maximum diameter of the score line 9 profile at the top surface of end wall 4. The dot-dash line 32 in FIG. 5 shows the diameter of the fold 17 extending beyond the maximum diameter 31 of the score line profile. FIG. 5 also shows an angled face 33 at the bottom of the score line 9 which directs the point of tear at the corner 30 of the score line.

The end wall 4 may have three buttons 27 embossed upwardly therein as shown in FIG. 1 to perform a dual function. First, the buttons 27 provide for level stacking of containers 1, one upon another. The bottom wall 2 of one container 1 will be supported tripod fashion on the three buttons 27 of the container next below. Second, the buttons 27 at either side of pull tab 11 engage the pull tab 11 and not only prevent the pull tab 11 from rotating out of proper position around rivet 12, but also locate the pull tab 11 in proper position as the rivet 12 is formed.

The underlap of rounded bead 17 beneath score line 9 provides, when can 1 is round, a diameter for removed panel portion 10 slightly greater than the diameter of the rim of the end wall 4 remaining on the can 1 after the panel 10 has been torn from the can. This, however, does not prevent removal, since the tendency of panel 10 to bulge or crowd upward when pulled by pull tab 11 permits the panel 10 to be pulled away from the can as it tears on score line 9.

The improved construction of the protective fold 13 for the can end eliminates the dangers and hazards that have characterized prior constructions, and answers the problem, which has existed in the aluminum canned food products field, in a practical manner and, thus, provides a construction which achieves the objectives and satisfies the needs that have existed in the art.

In the foregoing description, certain terms have been used for brevity, clearness and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described since the features of the invention may be applied to different sized cans.

Having now described the features, discoveries and principles of the invention, the manner in which the improved structure achieves the objectives, and the advantageous, new and useful results obtained; the new and useful structures, devices, elements, arrangements, parts, combinations, and sub-combinations are set forth in the appended claims.

We claim:

1. Easy opening metal food products can construction including a metal can body, an end wall, double seam means connecting the end wall to the can body; an inwardly projecting annular bead formed in the can body side wall below the seam means; the end wall having a recessed corner located below the seam, and having a recessed portion extending from said corner; the end wall recessed corner being seated on said bead; an end-panel-defining continuous score line formed in the recessed portion close to the recessed corner; the inward projection of the bead being located radially inward of the profile of that portion of the end wall remaining on the can body after the end panel has been torn from the can on the score line; pull tab means secured to the end panel for tearing the end panel from the end wall; a protective three-layer fold formed in the end wall extending completely around and underlapping the score line; the fold comprising a first metal layer extending annularly inwardly from the score line and terminating in a reverse bend from which a second metal layer extends outwardly beneath the first metal layer and terminating in a second reverse metal bend from which a third metal layer extends inwardly beneath the first and second layers and into a main end panel portion of the end wall; the second reverse bend extending circumferentially outwardly beyond and below the location of the score line; the third metal layer extending inwardly to an offset panel portion; the offset panel portion merging by an angular wall portion into the main panel portion and forming an annular channel surrounded by the protective fold; and the main panel portion lying in the plane of the first fold layer.

2. A metal can end adapted to be connected by seam means to a can body having an inwardly projecting bead formation in the can side wall below the seam means; the can end having a seam flange and a recessed corner located below the seam flange, the recessed portion on the can end extending inwardly from the corner; an endpanel defining continuous score line formed in the recessed portion close to the recessed corner; the score line profile of that portion of the end wall remaining on the can body after the end panel has been torn from the can along the score line being located radially outward of the inward projection of the bead on the can body to which the metal can end is adapted to be seamed; pull tab means secured to the end panel for tearing the end panel from the end; a protective three-layer fold formed in the metal can end extending completely around and underlapping the score line; the three-layer fold comprising a first upper layer, a second intermediate layer, and a third bottom layer; the third layer extending inwardly to an offset panel portion; the offset portion forming an annular channel surrounded by the protective fold; the offset portion merging by a connecting wall portion into the main panel portion; the main panel portion lying in the plane of the first layer of the three-layer fold; and the outer diameter of the fold connecting between the second and third layers of the three-layer fold extending beyond the maximum diameter of the score line profile at the top surface of the recessed portion of the can end.

3. The construction defined in claim 2 in which the score line has a trapezoidal profile.

4. The construction defined in claim 2 in which a secondary score line is formed in the main panel portion between the offset portion annular channel and the location where the pull tab means is secured to the end panel; and in which the end panel bends on its secondary score line during rupture of the end panel on the continuous score line upon pulling the pull tab means.

5. A metal can end adapted to be seamed to a can body, the can end having a seam flange and a recessed corner located below the seam flange, a recessed portion extending from the corner; a removable end panel defined by a continuous score line formed in the recessed portion close to the recessed corner; pull tab means secured to the removable end panel for tearing the removable end panel from the end; a protective three layer double fold formed in the metal can end extending completely around and underlying the score line; the double fold including a three-layer S-like annular formation on the removable end panel adjacent the score line; the two lower layers of the three-layer formation extending outward beneath and circumferentially beyond the location of the score line; the lowermost layer of the three layer formation extending inwardly to an offset panel portion; the offset portion forming an annular channel surrounded by the three layer formation; the offset portion merging by a connecting wall portion into a main panel portion of the removable end panel; said main panel portion lying in the plane of the upper layer of the three layer formation; and said pull tab means being secured to the main panel portion inwardly of said annular channel.

* * * * *